US011629845B2

(12) United States Patent
Tsai

(10) Patent No.: US 11,629,845 B2
(45) Date of Patent: Apr. 18, 2023

(54) CLAMP LAMP

(71) Applicant: Qisda Corporation, Taoyuan (TW)

(72) Inventor: Chang-Yu Tsai, Taipei (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/567,841

(22) Filed: Jan. 3, 2022

(65) Prior Publication Data

US 2022/0243896 A1 Aug. 4, 2022

(30) Foreign Application Priority Data

Feb. 2, 2021 (TW) ..... 110103814

(51) Int. Cl.

| | |
|---|---|
| ***F21V 7/04*** | (2006.01) |
| ***F21V 9/40*** | (2018.01) |
| ***F21V 7/00*** | (2006.01) |
| ***F21V 21/088*** | (2006.01) |

(52) U.S. Cl.

CPC ..... *F21V 7/04* (2013.01); *F21V 7/0008* (2013.01); *F21V 9/40* (2018.02); *F21V 21/088* (2013.01)

(58) Field of Classification Search

CPC ..... F21V 7/005; F21V 7/0008; F21V 7/04; F21V 9/40; F21V 21/0888

See application file for complete search history.

(56) References Cited

U.S. PATENT DOCUMENTS 5,530,628 A * 6/1996 Ngai ..... F21V 7/28 362/127
2013/0235589 A1* 9/2013 Ohno ..... F21V 13/04 362/296.01
2018/0363889 A1* 12/2018 Yen ..... F21V 21/088

FOREIGN PATENT DOCUMENTS

CN 107631190 A 1/2018
CN 107975774 A 5/2018

OTHER PUBLICATIONS

Office action of counterpart application by Taiwan IP Office dated Sep. 11, 2021.

* cited by examiner

*Primary Examiner* — Andrew J Coughlin
*Assistant Examiner* — Nathaniel J Lee

(57) ABSTRACT

A clamp lamp could clamp a screen having a front surface and a rear surface is provided. The clamp lamp includes a first clip, a second clip and a light-emitting module. When the clamp lamp clamps an edge of the screen, the first and second clips abut on the front surface and the rear surface of the screen respectively. The light-emitting module is connected to the first clip and includes a casing, a light-emitting element and a light-reflecting element. The casing has a light outlet. The light-emitting element is disposed in the casing and configured to emit a light and reflect the light to illuminate the front of the front surface through the light outlet. The light-reflecting element has first and second reflecting surfaces connected to each other. The first reflecting surface has several reflecting points, each having a radius of curvature equal to or greater than 25 mm.

18 Claims, 4 Drawing Sheets

CLAMP LAMP

This application claims the benefit of Taiwan application Serial No. 110103814, filed Feb. 2, 2021, the subject matter of which is incorporated herein by reference.

BACKGROUND OF THE INVENTION

Field of the Invention

The invention relates in general to a clamp lamp.

Description of the Related Art

Conventional clamp lamp disposed on a screen can emit an illumination light to illuminate front of the screen. However, if the design of the clamp lamp is poor, the illumination light may illuminate display surface of the screen and generate a reflective light and/or a non-uniform distribution of brightness in an illumination area of the illumination light. Therefore, it has become a prominent task for the industries to provide a clamp lamp with suitable design that can obtain a suitable range of the illumination light.

SUMMARY OF THE INVENTION

The invention is directed to a clamp lamp capable of resolving the generally known problems disclosed above.

According to one embodiment of the present invention, a clamp lamp is provided. The clamp lamp is configured to clamp a screen having a front surface and a rear surface. The clamp lamp includes a first clip, a second clip and a light-emitting module. When the clamp lamp clamps an edge of the screen, the first clip and the second clip are configured to abut on the front surface and the rear surface of the screen respectively. The light-emitting module is connected to the first clip and includes a casing, a light-emitting element, a light-reflecting element and a light-transmitting element. The casing has a light outlet. The light-emitting element is disposed in the casing and configured to emit a light. The light-reflecting element is disposed in the casing and configured to reflect the light to illuminate a front of the front surface through the light outlet. The light-reflecting element has a first reflecting surface and a second reflecting surface connected to each other. The first reflecting surface is farther away from the light emitting element than the second reflecting surface. The first reflecting surface has a plurality of reflecting points, each having a radius of curvature equal to or greater than 25 mm. The light-transmitting element is disposed between the light-reflecting element and the light outlet and inclined relative to the light outlet, wherein there are a plurality of different distances between the light-transmitting element and the light outlet, and a larger one of the distances is closer to the front surface of the screen.

According to another embodiment of the present invention, a clamp lamp is provided. The clamp lamp is configured to clamp a screen having a front surface and a rear surface. The clamp lamp includes a first clip, a second clip, a light-emitting module and a light-transmitting element. When the clamp lamp clamps an edge of the screen, the first clip and the second clip are configured to abut on the front surface and the rear surface of the screen respectively. The light-emitting module is connected to the first clip and includes a casing, a light-emitting element and a light-reflecting element. The casing has a light outlet. The light-emitting element is disposed in the casing and configured to emit a light. The light-reflecting element is disposed in the casing and configured to reflect the light to illuminate a front of the front surface through the light outlet. The light-transmitting element is disposed between the light-reflecting element and the light outlet and has a light incident surface, which forms an acute angle with a light outlet. The light incident surface has a first point and a second point. The first point is farther away from the light-emitting element than the second point. The vertical distance from the first point to the light outlet is less than the vertical distance from the second point to the light outlet. The second point is closer to the front surface of the screen than the first point.

According to an alternate embodiment of the present invention, a clamp lamp is provided. The clamp lamp is configured to clamp a screen having a front surface and a rear surface. The clamp lamp includes a first clip, a second clip and a light-emitting module. The light-emitting module is connected to the first clip and includes a casing, a light-emitting element and a light-reflecting element. The casing has a light outlet. The light-emitting element is disposed in the casing and configured to emit a light. The light-reflecting element is disposed in the casing and configured to reflect the light to illuminate a front of the front surface through the light outlet. The light-reflecting element has a plurality of reflecting points. The radius of curvature of the reflecting points closer to the screen is greater than the radius of curvature of the reflecting points farther away from the screen.

According to an alternate embodiment of the present invention, a clamp lamp is provided. The clamp lamp is configured to clamp a screen having a front surface and a rear surface. The clamp lamp includes a first clip, a second clip and a light-emitting module. The first clip and the second clip abut on the front surface and the rear surface of the screen respectively when the clamp lamp clamps an edge of the screen. The light-emitting module is connected to the first clip and includes a casing, a light-emitting element, a light-reflecting element, a light absorption layer and a light-transmitting element. The light-emitting element is disposed in the casing and configured to emit light. The light-reflecting element is disposed in the casing and configured to reflect the light to illuminate front of the front surface through the light outlet. The light absorption layer is disposed in the casing and facing the light-emitting element and the front surface of the screen, wherein the light absorption layer is farther away from the light-emitting element than the light-reflecting element. The light-transmitting element is disposed between the light-reflecting element and the light outlet and has a light incident surface, wherein there is an acute angle included between a light incident surface and the light outlet, the light incident surface has a first point and a second point; the first point is farther away from the light-emitting element than the second point, an vertical distance from the first point to the light outlet is less than an vertical distance from the second point to the light outlet, and the second point is closer to the front surface of the screen than the first point.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
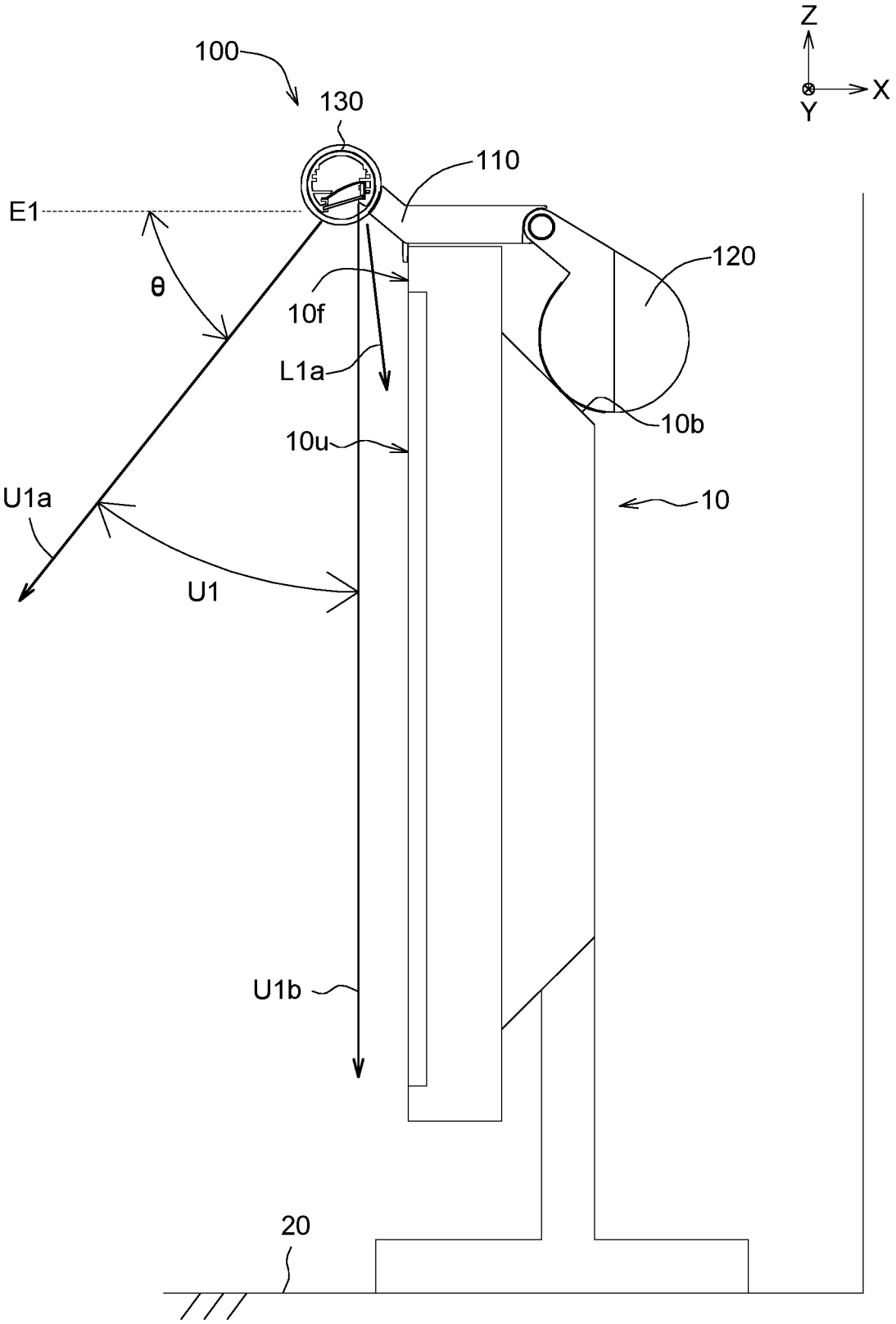
FIG. 1 is a schematic diagram of a clamp lamp clamping a screen according to an embodiment of the present invention.
Figure 2:
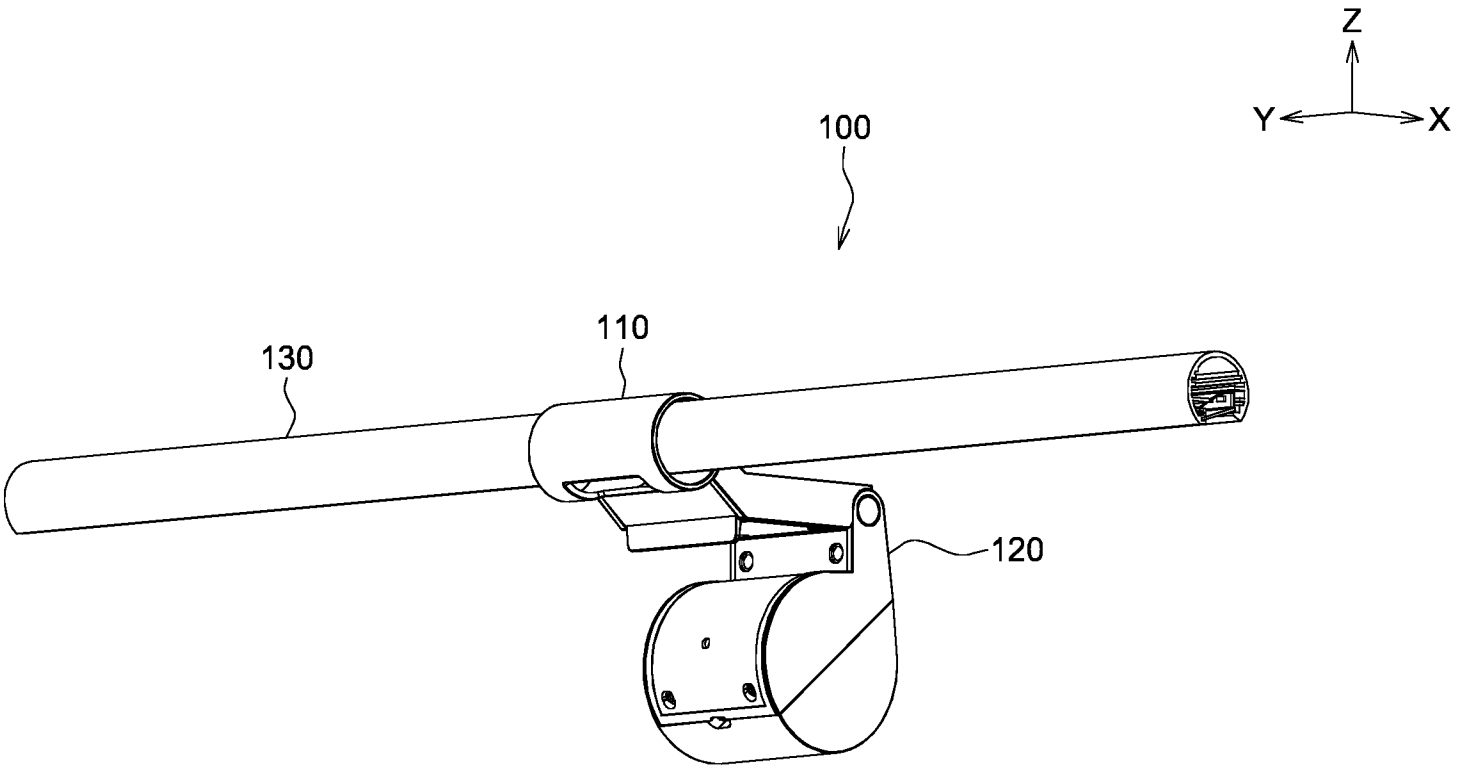
FIGS. 2 to 3 are schematic diagrams of the clamp lamp of FIG. 1.
Figure 3:
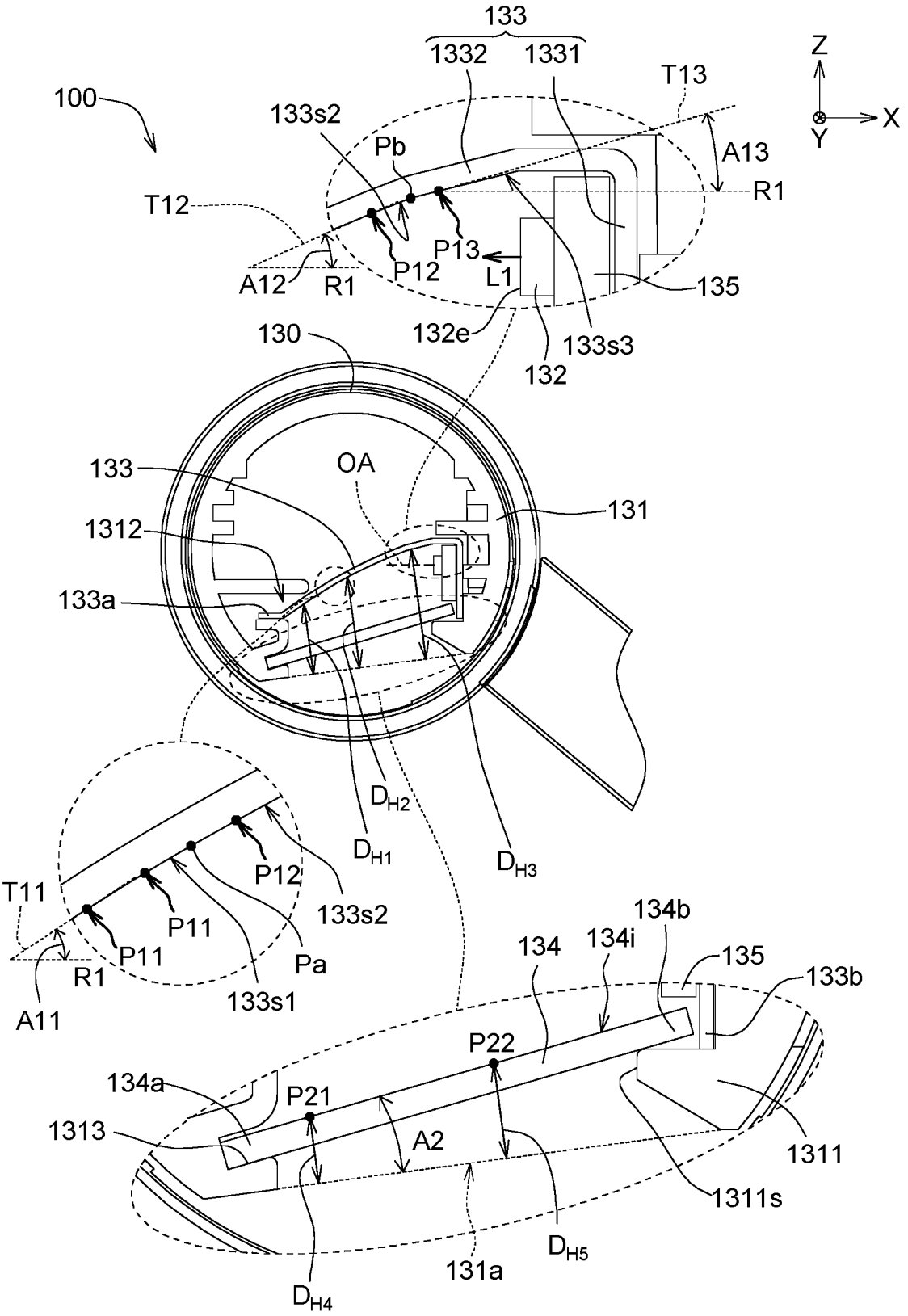

Refer to FIGS. 1 to 3. FIG. 1 is a schematic diagram of a clamp lamp 100 clamping a screen 10 according to an embodiment of the present invention. FIGS. 2 to 3 are schematic diagrams of the clamp lamp 100 of FIG. 1.

As indicated in FIG. 1, the clamp lamp 100 can clamp a screen 10, which has a front surface 10*f* and a rear surface 10*b*. As indicated in FIGS. 2 and 3, the clamp lamp 100 includes a first clip 110, a second clip 120 and a light-emitting module 130. When the clamp lamp 100 clamps an edge of the screen 10, the first clip 110 and the second clip 120 are configured to abut on the front surface 10*f* and the rear surface 10*b* of the screen 10 respectively. The light-emitting module 130 is connected to the first clip 110 and includes a casing 131, a light-emitting element 132, a light-reflecting element 133, a light-transmitting element 134 and a circuit board 135. The casing 131 has a light outlet 131*a*. The light-emitting element 132 is disposed in the casing 131 and configured to emit a light L1. The light-reflecting element 133 is disposed in the casing 131 and configured to reflect the light L1 to illuminate the front of the front surface 10*f* through the light outlet 131*a*. The light-reflecting element 133 has a first reflecting surface 133*s*1 and a second reflecting surface 133*s*2 connected to each other. The first reflecting surface 133*s*1 is farther away from the light-emitting element 132 than the second reflecting surface 133*s*2. The first reflecting surface 133*s*1 has several first reflecting points P11, each having a first radius of curvature C1 (not illustrated) equal to or greater than 25 mm. Thus, the brightness of the stray light L1*a* (illustrated in FIG. 1) of the light L1 can be inhibited (decreased) or even eliminated.

As indicated in FIG. 1, the light L1 emitted from the light outlet 131*a* forms an illumination area U1, which illuminates a carrying surface 20 (such as a desktop) of the screen 10. The part of the illumination area U1 far away from the screen 10 has an obvious boundary U1*a*, which forms an angle θ greater than 0° with the horizontal plane E1 to avoid the light of the illumination area U1 directly entering the user's eyes. Besides, the angle θ can be less than a predetermined angle, such as 10°, 20° or other values, such that the illumination area U1 can become a suitable or expected range of illumination. The part of the illumination area U1 close to the screen 10 has an obvious boundary, which is referred as a truncation line U1*b*. The ratio of the brightness of the stray light L1*a* between the truncation line U1*b* and the screen 10 to the brightness of the illumination area U1 is less than a predetermined ratio, such as 5% or other values. Based on the predetermined ratio, the position of the truncation line U1*b* can be defined. The brightness of the stray light L1*a* between the truncation line and the illumination area and the screen of the conventional clamp lamp negatively affects the frame quality of the display surface 10*u* of the screen 10 viewed by the user (such as light reflection). On the contrary, according to an embodiment of the present invention, with the design of the light-emitting module 130, the brightness of the stray light L1*a* can be inhibited (decreased) or even eliminated to avoid the stray light L1*a* negatively affecting the frame quality of the display surface 10*u* of the screen 10 viewed by the user.

As indicated in FIG. 3, the light-emitting element 132 is disposed on and electrically connected to the circuit board 135. The casing 131 includes a blocking portion 1311, which is located right below the circuit board 135 and the light-emitting element 132. The blocking portion 1311 blocks a part of the light L1 of the light-emitting element 132 (such as the edge light in the range of the beam angle) so to control the angle formed between the truncation line U1*b* and the display surface 10*u* of the screen 10. In the present embodiment, the end surface 1311*s* of the blocking portion 1311 is substantially coplanar with the light-emitting surface 132*e* of the light-emitting element 132, such that the truncation line U1*b* is substantially parallel to the display surface 10*u* of the screen 10. However, the end surface 1311*s* and the light-emitting surface 132*e* are not necessarily coplanar and any arrangements would do as long as the direction of the light-emitting surface 132*e* along the optical axis OA is not protruded over the end surface 1311*s*.

In an embodiment, the first radius of curvature C1 of each first reflecting point P11 on the first reflecting surface 133*s*1 can be in a range of 25 millimeter (mm) to 200 mm (inclusive of the values of the end points), such that the brightness of the stray light L1*a* can be inhibited (decreased) or even eliminated. As indicated in FIG. 3, the tangent direction T11 of each first reflecting point P11 can form a first angle A11 in a range of 15° to 60° with the reference axis R1. However, the angle can also be less than 15° or is greater than 60°. The reference axis R1 is substantially parallel to the optical axis of OA of the light-emitting element 132, such that the brightness of the stray light L1*a* can be inhibited (decreased) or even eliminated. The first reflecting points P11 are smoothly distributed to form a first reflecting surface 133*s*1. Furthermore, the values of at least two of the first radii of curvature C1 can be identical or different.

As indicated in FIG. 3, the second reflecting surface 133*s*2 has several second reflecting points P12, each having a second radius of curvature C2 (not illustrated) equal to or greater than 30 mm. Thus, the brightness of the illumination area U1 can be uniformed. In an embodiment, each second radius of curvature C2 can be in a range of 25 mm to 200 mm (inclusive of the end points). Moreover, the tangent direction T12 of each second reflecting point P12 can form a second angle A12 in a range of 10° to 45° with the reference axis R1. However, the second angle A12 can also be less than 10° or is greater than 45°, such that the brightness of the illumination area U1 can be uniformed. Besides, the optical axis of OA of the light-emitting element 132 can pass through the second reflecting surface 133*s*2, such that most of the light emitted the light-emitting element 132 or the light emitted the light-emitting element 132 with larger light energy can be reflected by the second reflecting surface 133*s*2 to form the range of the illumination area U1. The second reflecting points P12 are smoothly distributed to form the second reflecting surface 133*s*2. Furthermore, the values of at least two of the second radii of curvature C2 can be identical or different.

As indicated in FIG. 3, the light-reflecting element 133 further includes a third reflecting surface 133*s*3 connected to the second reflecting surface 133*s*. The second reflecting surface 133*s*2 is farther away from the light-emitting element 132 than the third reflecting surface 133*s*3. The third reflecting surface 133*s*3 has several third reflecting points P13. The third reflecting points P13 form a third reflecting surface 133*s*3 and are smoothly distributed. Each third reflecting point P13 has a third radius of curvature C3 (not illustrated) equal to or greater than 1000 mm. The third radius of curvature C3 is greater than the first radius of curvature C1 and the second radius of curvature C2. Thus, the truncation line U1*b* is substantially parallel to the display surface 10*u* of the screen 10 (as indicated in FIG. 1). Furthermore, at least two of the third radii of curvature C3 can be identical or different. In an embodiment, the maximum of each third radius of curvature C3 can be infinite. Under such design, at least a part of the third reflecting surface 133*s*3 is planar.

As indicated in FIG. 3, the tangent direction T13 of each third reflecting point P13 can form a third angle A13 in a range of 0° to 20° with the reference axis R1. However, the third angle A13 can be greater than 20°, such that the truncation line U1*b* is substantially parallel to the display surface 10*u* of the screen 10 as indicated in FIG. 1.

As indicated in FIG. 3, the light-reflecting element 133 is inclined relative to the light outlet 131*a*. For example, the vertical distance $D_{H1}$ from any first reflecting point P11 on the first reflecting surface 133*s*1 to the light outlet 131*a* (such as perpendicular to the light outlet 131*a*) is less than the vertical distance $D_{H2}$ from any second reflecting point P12 on the second reflecting surface 133*s*2 to the light outlet 131*a* (such as perpendicular to the light outlet 131*a*); and the vertical distance $D_{H2}$ from any second reflecting point P12 on the second reflecting surface 133*s*2 to the light outlet 131*a* is less than the vertical distance $D_{H3}$ from any third reflecting point P13 on the third reflecting surface 133*s*3 to the light outlet 131*a* (such as perpendicular to the light outlet 131*a*).

As indicated in FIG. 3, the first reflecting surface 133*s*1 and the second reflecting surface 133*s*2 can be smoothly connected. For example, a first connection point Pa is formed between the first reflecting surface 133*s*1 and the second reflecting surface 133*s*2, and the tangent direction of the first connection point Pa on the first reflecting surface 133*s*1 substantially overlaps the tangent direction of the first connection point Pa on the second reflecting surface 133*s*2. Similarly, the second reflecting surface 133*s*2 and the third reflecting surface 133*s*3 can be smoothly connected. For example, a second connection point Pb is formed between the second reflecting surface 133*s*2 and the third reflecting surface 133*s*3, and the tangent direction of the second connection point Pb on the second reflecting surface 133*s*2 substantially overlaps the tangent direction of and the second connection point Pb on the third reflecting surface 133*s*3.

As indicated in FIG. 3, the light-reflecting element 133 further includes a carrying portion 1331 and a reflecting portion 1332 connected to each other. The reflecting portion 1332 has a first reflecting surface 133*s*1, a second reflecting surface 133*s*2 and a third reflecting surface 133*s*3. In the present embodiment, the carrying portion 1331 and the reflecting portion 1332 are integrally formed in one piece. In another embodiment, the carrying portion 1331 and the reflecting portion 1332 can be separately formed then bonded using a temporary or permanent technology. The light-reflecting element 133 can have a reflectivity higher than 90%. In terms of material, the light-reflecting element 133 can be formed of aluminum with high reflectivity.

As indicated in FIG. 3, relative position between the light-reflecting element 133 and the casing 131 is fixed. For example, the light-reflecting element 133 and the casing 131 are engaged so that the relative position can be fixed. In embodiment, the casing 131 includes at least one limiting portion 1312, in which the first end 133*a* of the light-reflecting element 133 is located. In the present embodiment, the limiting portion 1312 can be realized by a notch. Moreover, the second end 133*b* of the light-reflecting element 133 can abut on the blocking portion 1311 of the casing 131. Alternatively, the second end 133*b* does not have to abut on the blocking portion 1311. Although it is not illustrated, in another embodiment, the blocking portion 1311 can have a notch, with which the second end 133*b* of the light-reflecting element 133 can be tightly engaged, such that the relative position between the light-reflecting element 133 and the casing 131 can be more firmly fixed. The method for bonding the light-reflecting element 133 and the casing 131 is specified in the embodiments of the present invention, and any bonding methods would do as long as the relative position can be fixed.

As indicated in FIG. 3, the light-transmitting element 134 disposed between the light-reflecting element 133 and the light outlet 131*a* is permeable to light, allows the light to pass through, and provides the effect of waterproof and dustproof. In another embodiment, the light-emitting module 130 can dispense with the light-transmitting element 134 unless the light-transmitting element 134 is necessary. The light-transmitting element 134 is inclined relative to the light outlet 131*a*, such that the lights with larger angles between the light reflected by the light-reflecting element 133 and the light directly emitted by the light-emitting element 132 can stay in the casing 131 through the reflection and refraction of the light incident surface 134*i* instead of being projected towards the display surface 10*u*. Besides, since the light-transmitting element 134 abuts on the blocking portion 1311, the lights with larger angels (if passing through the light-transmitting element 134) can be projected to the end surface 1311*s* of the blocking portion 1311, such that the amount of the light projected towards the display surface 10*u* will be reduced. There are several distances formed between the light-transmitting element 134 and the light outlet 131*a*, and larger distances are closer to the front surface 10*f* of the screen 10. As indicated in FIG. 3, the light-transmitting element 134 is disposed between the light-reflecting element 133 and the light outlet 131*a* and has a light incident surface 134*i*, which forms an acute angle A2 with the light outlet 131*a*. The light incident surface 134*i* has a first point P21 and a second point P22. The first point P21 is farther away from the light-emitting element 132 than the second point P22. The vertical distance DH4 from the first point P21 to the light outlet 131*a* (such as perpendicular to the light outlet 131*a*) is less than the vertical distance $D_{H5}$ from the second point P22 to the light outlet 131*a* (such as perpendicular to the light outlet 131*a*). The second point P22 is closer to the front surface 10*f* of the screen 10 than the first point P21 (the front surface 10*f* is illustrated in FIG. 1).

As indicated in FIG. 3, relative position between the light-transmitting element 134 and the casing 131 is fixed. For example, the light-transmitting element 134 is engaged with the casing 131. In embodiment, the casing 131 includes at least one engaging portion 1313, in which the first end 134*a* of the light-transmitting element 134 is located. In an embodiment, the engaging portion 1313 can be realized by a notch, in which the first end 134*a* of the light-transmitting element 134 can be tightly engaged to fix the relative position between the light-transmitting element 134 and the casing 131. The second end 134*b* of the light-transmitting element 134 can abut on the blocking portion 1311. In another embodiment, the second end 134*b* of the light-transmitting element 134 can abut on the light-reflecting element 133 by the carrying portion 1331 for example. Although it is not illustrated, in another embodiment, the blocking portion 1311 can have a notch, in which the second end 134*b* of the light-transmitting element 134 can be tightly engaged, such that the relative position between the light-transmitting element 134 and the casing 131 can be more firmly fixed. The method for bonding the light-transmitting element 134 and the casing 131 is specified in the embodiments of the present invention, and any bonding methods would do as long as the relative position can be fixed. Moreover, the light-transmitting element 134 can be formed of a light-transmitting polymer such as light-transmitting plastics, but the invention is not limited thereto.

As indicated in FIG. 3, the circuit board 135 can be disposed on the light-reflecting element 133 by the carrying portion 1331 for example. The circuit board 135 includes at least one circuit, the anode (not illustrated) and the cathode (not illustrated) of the light-emitting element 132 are respectively electrically connected to two circuits of the circuit board 135. The controller (not illustrated) of the clamp lamp 100 can control the light-emitting mode of the light-emitting element 132 through the circuits of the circuit board 135.

Figure 4:
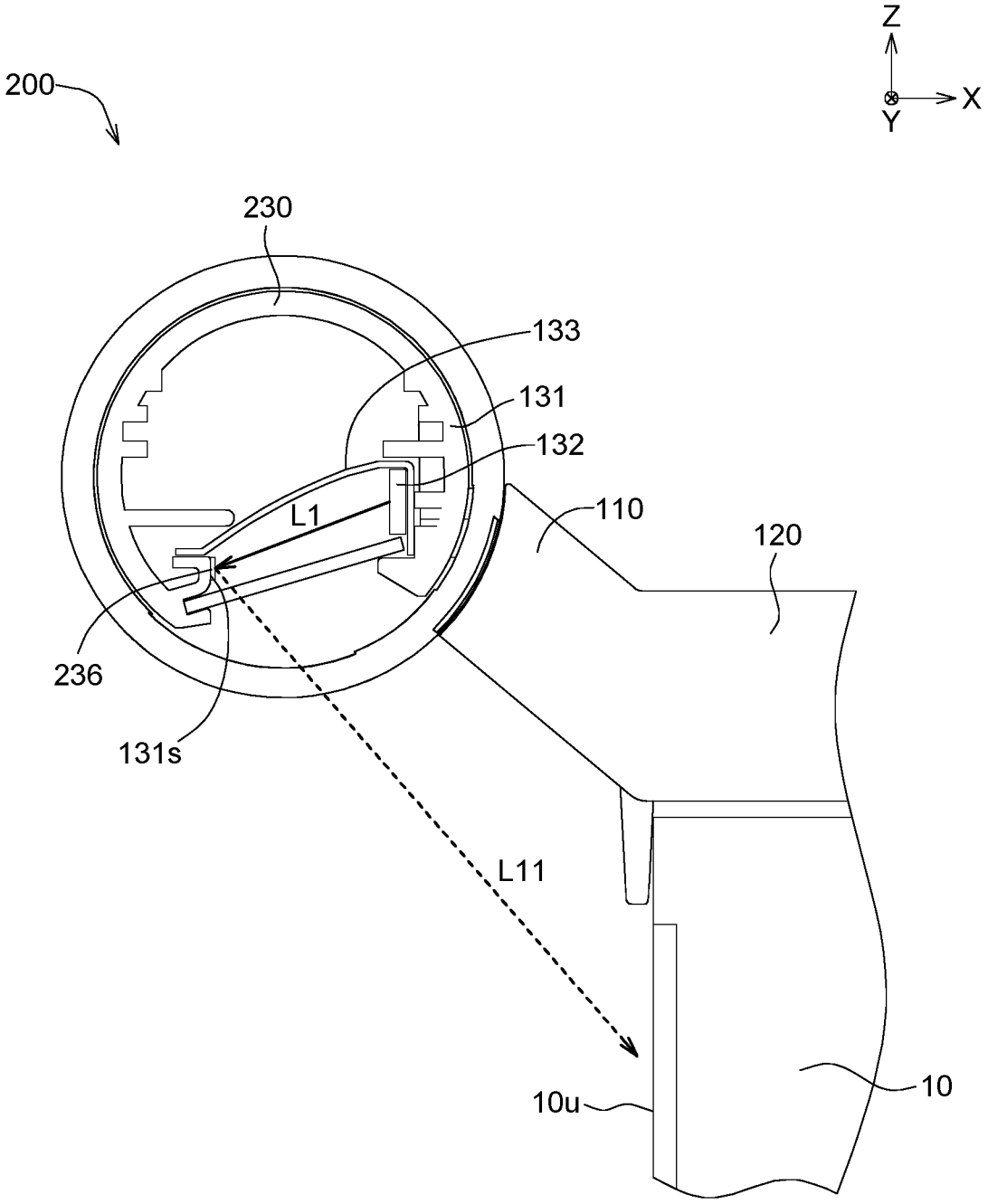
FIG. 4 is a schematic diagram of a clamp lamp according to another embodiment of the present invention.

Referring to FIG. 4, a schematic diagram of a clamp lamp 200 according to another embodiment of the present invention is shown.

The clamp lamp 200 is configured to clamp the screen 10. The clamp lamp 200 includes a first clip 110, a second clip 120 and a light-emitting module 230. The light-emitting module 230 includes a casing 131, a light-emitting element 132, a light-reflecting element 133, a light-transmitting element 134, a circuit board 135 and a light absorption layer 236. The clamp lamp 200 and the clamp lamp 100 have similar or identical features but are different in that the light-emitting module 230 of the clamp lamp 200 further includes a light absorption layer 236. The light absorption layer 236 can be formed of light-absorbing foam or light-absorbing flannel.

The light absorption layer 236 can be disposed on a surface 131*s* of the casing 131. The surface 131*s* is located on the optical path of the light L1 and opposite to the light-emitting element 132. The light absorption layer 236 is opposite to the light-emitting element 132 and the front surface 10*f* of the screen 10. The light absorption layer 236 is farther away from the light-emitting element 132 than the light-reflecting element 133. Thus, the light absorption layer 236 can absorb the light L1 to avoid the light L1 being reflected to the display surface 10*u* of the screen 10. In other words, if the light absorption layer 236 is omitted, the reflected light L11 reflected from the surface 131*s* (represented by dotted lines) will projected to the area between the illumination area U1 and the screen 10 and form stray light. With the design of the light absorption layer 236, the amount of the light reflected from the casing 131 can be reduced, such that the stray light can be reduced or even eliminated.

To summarize, the clamp lamp disclosed in above embodiments of the present invention clamps the screen and includes a light-emitting module. The light-reflecting element of the light-emitting module has a reflecting surface with varying curvatures and provides at least one of the following effects: (1) the truncation line of the illumination area is substantially parallel to the display surface of the screen. (2) the brightness of the illumination area is uniformed; and (3) the stray light is inhibited (decreased) or even eliminated. In another embodiment, the light-emitting module further includes a light absorption layer located on the optical path of the light. The light absorption layer can absorb the light and reduce the amount of the light reflected to the display surface of the screen.

While the invention has been described by way of example and in terms of the preferred embodiment (s), it is to be understood that the invention is not limited thereto. On the contrary, it is intended to cover various modifications and similar arrangements and procedures and the scope of the appended claims therefore should be accorded the broadest interpretation so as to encompass all such modifications and similar arrangements and procedures.

What is claimed is:

1. A clamp lamp configured to clamp a screen having a front surface and a rear surface, and comprising:

a first clip;

a second clip, wherein when the clamp lamp clamps an edge of the screen, the first clip and the second clip are configured to abut on the front surface and the rear surface of the screen respectively; and a light-emitting module connected to the first clip and comprising:

a casing having a light outlet;

a light-emitting element disposed in the casing and configured to emit light;

a light-reflecting element disposed in the casing and configured to reflect the light to illuminate front of the front surface through the light outlet, wherein the light-reflecting element has a first reflecting surface and a second reflecting surface connected to each other; the first reflecting surface is farther away from the light-emitting element than the second reflecting surface and has a plurality of first reflecting points each having a first radius of curvature equal to or greater than 25 mm, wherein a light absorption layer disposed in the casing and facing the light-emitting element and the front surface of the screen is farther away from the light-emitting element than the light-reflecting element; and a light-transmitting element disposed between the light-reflecting element and the light outlet.

2. The clamp lamp according to claim 1, wherein a first angle of a tangent direction of each first reflecting point relative to a reference axis ranged between 15° to 60°, wherein the reference axis is substantially parallel to an optical axis of the light-emitting element.

3. The clamp lamp according to claim 1, wherein the second reflecting surface has a plurality of second reflecting points each having a second radius of curvature equal to or greater than 30 mm.

4. The clamp lamp according to claim 3, wherein a second angle of a tangent direction of each second reflecting point relative to a reference axis ranges between 10° to 45°, wherein the reference axis is substantially parallel to an optical axis of the light-emitting element.

5. The clamp lamp according to claim 1, wherein an optical axis of the light-emitting element passes through the second reflecting surface.

6. The clamp lamp according to claim 1, wherein the light-reflecting element further comprises the second reflecting surface and a third reflecting surface connected to each other; the second reflecting surface is farther away from the light-emitting element than the third reflecting surface; the third reflecting surface has a plurality of third reflecting points each having a third radius of curvature equal to or greater than 1000 mm, and the third radius of curvature is greater than the first radius of curvature and the second radius of curvature.

7. The clamp lamp according to claim 6, wherein a third angle of a tangent direction of each third reflecting point ranges between 0° to 20° with a reference axis substantially parallel to the optical axis of the light-emitting element.

8. The clamp lamp according to claim 1, wherein the light-reflecting element further comprises a carrying portion and a reflecting portion connected to each other, the reflecting portion has the first reflecting surface and the second reflecting surface, and the light-emitting module further comprises:

a circuit board disposed on the carrying portion;

wherein the light-emitting element is disposed on and electrically connected to the circuit board, and the carrying portion and the reflecting portion are integrally formed in one piece.

9. The clamp lamp according to claim 1, wherein a vertical distance from any point on the first reflecting surface to the light outlet is less than a vertical distance from any point on the second reflecting surface to the light outlet.

10. A clamp lamp configured to clamp a screen having a front surface and a rear surface, and comprising:

a first clip;

a second clip, wherein when the clamp lamp clamps an edge of the screen, the first clip and the second clip are configured to abut on the front surface and the rear surface of the screen respectively; and a light-emitting module connected to the first clip and comprising:

a casing having a light outlet;

a light-emitting element disposed in the casing and configured to emit light;

a light-reflecting element disposed in the casing and configured to reflect the light to illuminate front of the front surface through the light outlet, wherein a light absorption layer disposed in the casing and facing the light-emitting element and the front surface of the screen is farther away from the light-emitting element than the light-reflecting element; and a light-transmitting element disposed between the light-reflecting element and the light outlet and having a light incident surface, wherein there is an acute angle included between a light incident surface and the light outlet, the light incident surface has a first point and a second point; the first point is farther away from the light-emitting element than the second point, a vertical distance from the first point to the light outlet is less than a vertical distance from the second point to the light outlet, and the second point is closer to the front surface of the screen than the first point.

11. The clamp lamp according to claim 10, wherein the light-reflecting element has a first reflecting surface and a second reflecting surface connected to each other; the first reflecting surface is farther away from the light-emitting element than the second reflecting surface and has a plurality of first reflecting points, and a first angle of a tangent direction of each first reflecting point relative to a reference axis ranges between 15° to 60°, wherein the reference axis is substantially parallel to an optical axis of the light-emitting element.

12. The clamp lamp according to claim 11, wherein a second angle of a tangent direction of each second reflecting point ranges relative to a reference axis between 10° to 45°.

13. The clamp lamp according to claim 10, wherein the light-reflecting element further comprises a second reflecting surface and a third reflecting surface connected to each other; the second reflecting surface is farther away from the light-emitting element than the second reflecting surface; the third reflecting surface has a plurality of third reflecting points each having a third radius of curvature equal to or greater than 1000 mm.

14. A clamp lamp configured to clamp a screen having a front surface and a rear surface, and comprising:

a first clip;

a second clip, when the clamp lamp clamps an edge of the screen, wherein the first clip and the second clip are configured to abut on the front surface and the rear surface of the screen respectively; and a light-emitting module connected to the first clip and comprising:

a casing has a light outlet;

a light-emitting element disposed in the casing and configured to emit light; and a light-reflecting element disposed in the casing and configured to reflect the light to illuminate front of the front surface through the light outlet, wherein the light-reflecting element has a plurality of reflecting points, a radius of curvature of the reflecting point closer to the screen is greater than a radius of curvature of the reflecting point farther away from the screen, wherein a light absorption layer disposed in the casing and facing the light-emitting element and the front surface of the screen is farther away from the light-emitting element than the light-reflecting element.

15. The clamp lamp according to claim 14, wherein the light-reflecting element comprises a first reflecting surface, a second reflecting surface and a third reflecting surface connected with one another; the third reflecting surface is closer to the light-emitting element than the second reflecting surface, and the second reflecting surface is closer to the light-emitting element than the first reflecting surface; the first reflecting surface has a plurality of first reflecting points, the second reflecting surface has a plurality of second reflecting points, and the third reflecting surface has a plurality of third reflecting points; each first reflecting point has a first radius of curvature, each second reflecting point has a second radius of curvature, and each third reflecting point has a third radius of curvature greater than the first radius of curvature and the second radius of curvature.

16. A clamp lamp configured to clamp a screen having a front surface and a rear surface, and comprising:

a first clip;

a second clip, wherein the first clip and the second clip abut on the front surface and the rear surface of the screen respectively when the clamp lamp clamps an edge of the screen; and a light-emitting module connected to the first clip and comprising:

a casing has a light outlet;

a light-emitting element disposed in the casing and configured to emit light; and a light-reflecting element disposed in the casing and configured to reflect the light to illuminate front of the front surface through the light outlet;

a light absorption layer disposed in the casing and facing the light-emitting element and the front surface of the screen, wherein the light absorption layer is farther away from the light-emitting element than the light-reflecting element;

a light-transmitting element disposed between the light-reflecting element and the light outlet and having a light incident surface, wherein there is an acute angle included between a light incident surface and the light outlet, the light incident surface has a first point and a second point, the first point is farther away from the light-emitting element than the second point, a vertical distance from the first point to the light outlet is less than a vertical distance from the second point to the light outlet, and the second point is closer to the front surface of the screen than the first point.

17. The clamp lamp according to claim 16, wherein the light-reflecting element has a first reflecting surface and a second reflecting surface connected to each other; the first reflecting surface is farther away from the light-emitting element than the second reflecting surface and has a plurality of first reflecting points, and a first angle of a tangent direction of each first reflecting point relative to a reference axis ranges between 15° to 60°, wherein the reference axis is substantially parallel to an optical axis of the light-emitting element.

18. The clamp lamp according to claim 17, wherein the light-reflecting element further comprises a third reflecting surface connected to the second reflecting surface; the second reflecting surface is farther away from the light-emitting element than the second reflecting surface; the third reflecting surface has a plurality of third reflecting points each having a third radius of curvature equal to or greater than 1000 mm.

* * * * *